US007004242B2

(12) United States Patent
Gong et al.

(10) Patent No.: US 7,004,242 B2
(45) Date of Patent: Feb. 28, 2006

(54) ENHANCED HEAT EXCHANGER APPARATUS AND METHOD

(75) Inventors: Ying Gong, Collierville, TN (US); Xiaobo Zhu, Germantown, TN (US)

(73) Assignee: Advanced Heat Transfer, LLC, Memphis, TN (US)

( * ) Notice: Subject to any disclaimer, the term of this patent is extended or adjusted under 35 U.S.C. 154(b) by 0 days.

(21) Appl. No.: 10/867,053

(22) Filed: Jun. 14, 2004

(65) Prior Publication Data

US 2005/0274503 A1 Dec. 15, 2005

(51) Int. Cl.
*F28D 1/04* (2006.01)

(52) U.S. Cl. ..... 165/151; 165/172; 165/182

(58) Field of Classification Search ..... 165/151, 165/172, 181, 182

See application file for complete search history.

(56) References Cited

U.S. PATENT DOCUMENTS

| | | | | |
|---|---|---|---|---|
| 4,561,494 A | | 12/1985 | Frost | |
| 4,984,626 A | | 1/1991 | Esformes et al. | |
| 5,036,911 A | | 8/1991 | So et al. | |
| 6,125,925 A | * | 10/2000 | Obosu et al. | 165/151 |

FOREIGN PATENT DOCUMENTS

| | | | |
|---|---|---|---|
| EP | 0384316 | | 8/1990 |
| EP | 430852 | | 6/1991 |
| JP | 58-158496 | * | 9/1983 |
| JP | S59-182378 | | 8/1984 |
| JP | 61-060221 | * | 3/1986 |
| JP | 61-79993 | * | 4/1986 |
| JP | 63-108195 | * | 5/1988 |
| JP | 402029597 A | | 7/1988 |
| JP | 1-212894 | * | 8/1989 |
| JP | 2-29597 | * | 1/1990 |
| JP | 2-217158 | * | 8/1990 |

OTHER PUBLICATIONS

Notification of Transmittal of the International Search Report and The Written Opinion of the International Searching Authority, mailed Jul. 20, 2004 for International application No. PCT/US04/34369.

* cited by examiner

*Primary Examiner*—Teresa J. Walberg
(74) *Attorney, Agent, or Firm*—Brooks Kushman P.C.

(57) ABSTRACT

A heat exchanger apparatus 10 that has one or more tubes 12 for carrying a first heat transfer fluid, such as a refrigerant. Fins are provided in thermal communication with the tubes. Some of the fins have fin collar bases 16 that are positioned around the outside perimeters of the tubes 12. One or more bumps 20 protrude from at least some of the fin collar bases 16. The bumps disturb a second heat transfer fluid, such as air, that passes over the fins 14 and the tubes 12. Also disclosed is a method for improving the efficiency of heat exchangers.

16 Claims, 4 Drawing Sheets

ENHANCED HEAT EXCHANGER APPARATUS AND METHOD

BACKGROUND OF THE INVENTION

1. Field of the Invention

This invention relates to (1) a heat exchanger, and more particularly to a heat exchanger having fins and tubes that are used primarily, although not exclusively in the heating, ventilation, air conditioning and refrigeration (HVACR) industry; and (2) a method for improving the efficiency of such heat exchangers.

2. Background Art

The Department of Energy (DOE) announced on Apr. 2, 2004 that it will enforce a 13 seasonal energy efficiency rating "SEER" standard for residential central air conditioners. This regulation affects residential central air conditioners and heat pumps. After Jan. 23, 2006, equipment manufactured must make the 13 SEER standard. It increases by 30% the SEER standard that applies to models sold at this time. Accordingly, manufacturers face a significant challenge in meeting the deadline for the thirteen SEER standard within the time allotted. This change in government-mandated standards gives rise to a need for higher efficiency in heat exchangers.

Conventionally, fin and tube heat exchangers used in the HVACR industry are constructed from round copper tubes and aluminum fins. Heat transfer by conduction and convection occurs, for example, from a fluid such as air flowing through the aluminum fins and around the copper tubes to the refrigerant carried in the tubes. For heating applications, the heat exchanger may be constructed of stainless steel or other materials to manage high temperatures, thermal cycling, and a corrosive environment.

Traditionally, a fin collar base is provided upon the fin, through which an outside diameter of a tube passes.

It is also known that one factor which limits local convective heat transfer is the presence of thermal boundary layers located on the plate fin surfaces of heat exchangers. Accordingly, conventional fins are often provided with means for varying surface topography or enhancements that disturb the boundary layer, thereby improving efficiency of heat transfer between the fluid passing through the tubes and the fluid that passes over the plate fin surfaces.

In the case of fin and tube heat exchangers, it is known that using protrusions at critical locations on the fin surface adjacent to a tube will enhance airside heat transfer performance of the heat exchanger. The provision of louvers, for example, tends to reduce the thickness of the hydrodynamic boundary layer. They tend to generate secondary flows which increase the efficiency of heat transfer. But large numbers of louvers, if added to a surface to improve heat transfer, usually are accompanied by an increase in pressure drop through the heat transfer apparatus, which is—other things being equal—an undesirable consequence.

Louvers are provided by rotating material adjacent to a slit, or between parallel slits about a plane of the fin to a prescribed angle. Such processes may be cumbersome to manufacture and confer relatedly adverse manufacturing economics. This arises because, under traditional approaches, many punching stations are needed to sheer the fin strip in order to define the louvers. This step may produce waste material in the form of scrap fragments that can diminish the life of a forming dye.

Also, there is a need to make such exchangers competitively, while reducing waste material, improving heat energy dissipation characteristics and prolonging the life of the manufacturing equipment necessary to make the heat exchanger apparatus.

Among the relevant prior art are these references: EP0430852; EP0384316; U.S. Pat. Nos. 4,984,626; 4,561,494 and 5,036,911, the disclosures of which are incorporated by reference.

SUMMARY OF THE INVENTION

It is therefore an object of the present invention to improve heat transfer characteristics by providing an enhanced fin adjacent to the tube interface in a plate fin heat exchanger.

Yet another object of the present invention is to provide an enhanced plate fin while decreasing the boundary layer thickening by promoting a means for disturbance having a size nearly equal to or greater than that of the boundary layer and directing the means into the boundary layer in order to activate the fluid of which the boundary layer is composed.

According to one aspect of the invention, a heat exchanger is provided for, but not necessarily limited to, the heating, ventilation, air conditioning and refrigeration industry. The heat exchanger has one or more tubes that carry a refrigerant. In thermal communication with the tube are one or more fins. Some of the fins have thin collar bases that are positioned around the outside perimeters of the tubes. At least some of the fin collar bases are provided with one or more protrusions that enhance heat transfer by disturbing the airflow that passes over the fins around the tubes.

Other objects and advantages will become apparent from the following specification taken in connection with the accompanying drawings.

DETAILED DESCRIPTION OF THE PREFERRED EMBODIMENT(S)

Figure 1:
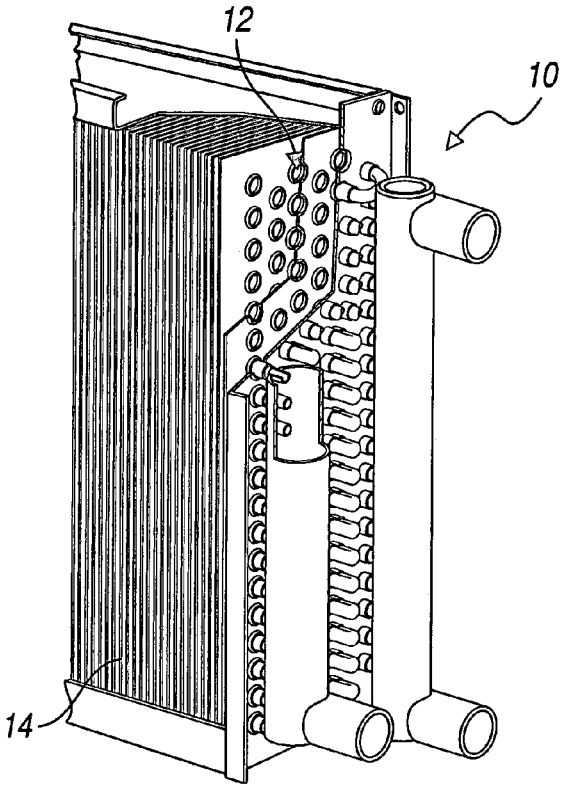
FIG. 1 (PRIOR ART)
FIG. 1 depicts a quartering perspective, partially broken away view of a section of a conventional fin-tube coil.
Figure 2:
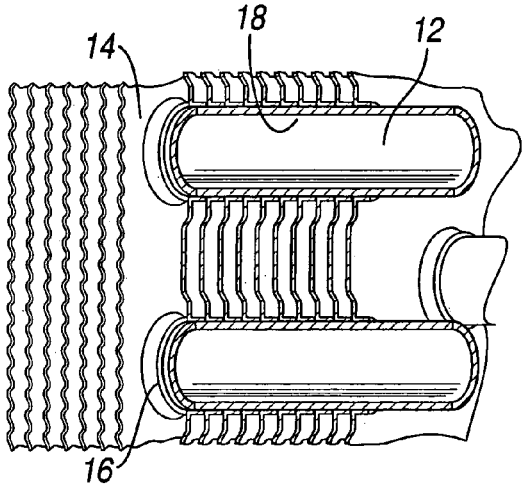
FIG. 2 (PRIOR ART)
FIG. 2 is an enlarged view of conventional fins through which the tubes pass.

With reference to FIGS. 1–6, there is depicted a heat exchanger 10 that has one or more tubes 12 that carry a first heat transfer fluid, such as a refrigerant. It will be appreciated that alternative first heat transfer fluids include $CO_2$, Freon®, HC, FC, R134A, R22, R410a, R404a, and the like. In thermal communication with the tubes, there are one or more fins 14. At least some of the fins 14 have a plurality of fin collar bases 16 that are positioned around the outside perimeters 18 of the tubes 12.

At least some of the plurality of fin collar bases 16 are provided with one or more protrusions 20 (FIGS. 5–6) for disturbing a second heat transfer fluid, such as air or another fluid, that passes over the fins 14 and the tubes 12.

In the fin and tube heat exchanger that is the subject of this invention, several inventive embodiments (to be described below) can be deployed with good advantage in the heating, ventilation, air conditioning and refrigeration (HVACR) industry. The tubes are typically constructed from a metal or metal alloy that is a relatively good conductor of thermal energy, such as copper or aluminum or a non-metallic material such as nylon or a polymeric material. Typically, the fins are made from an aluminum or aluminum alloy or copper or a copper alloy. For example, heat transfer may occur from the air (second heat transfer fluid) through the aluminum fins and the copper tubes to a refrigerant (first heat transfer fluid) in the tubes by conduction and convection.

Figure 4:
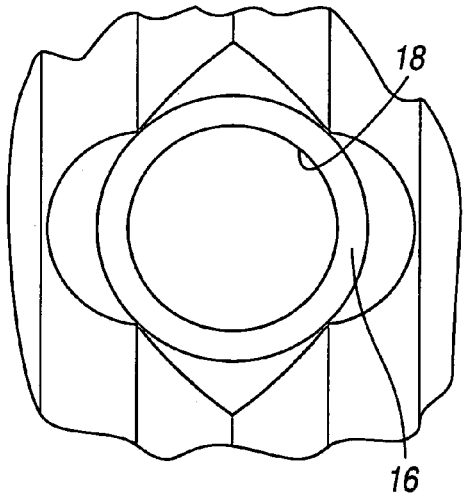
FIG. 4 (PRIOR ART)
FIG. 4 depicts an enlarged cross-sectional view of a conventional fin collar base which contacts the tube's outside perimeter.
Figure 5:
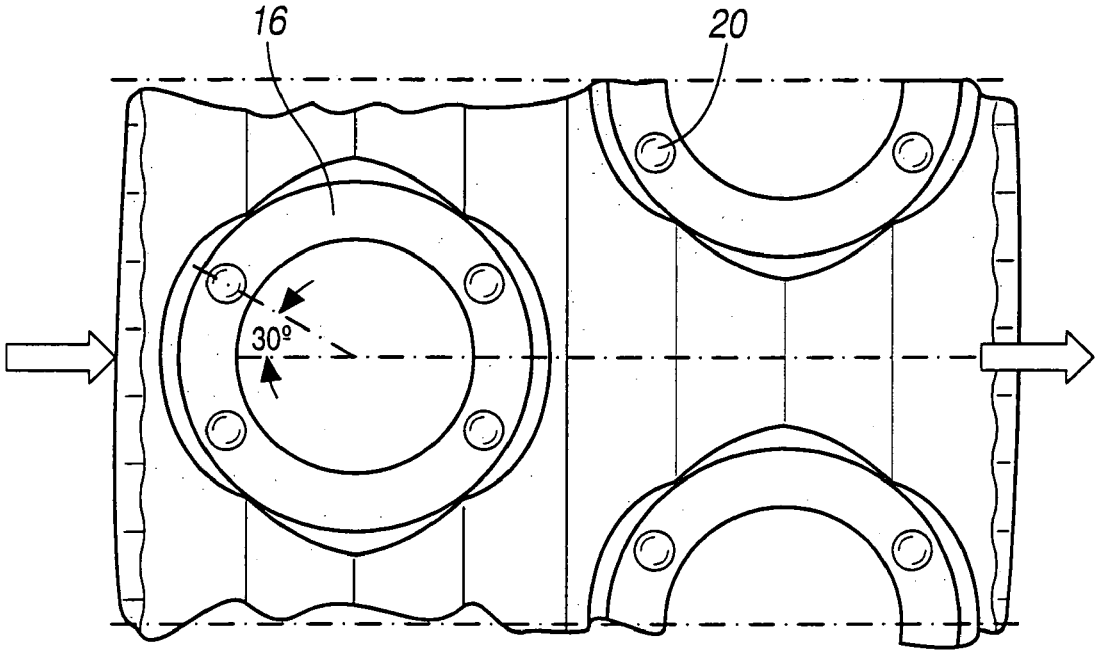
FIG. 5 represents an inventive bump-enhanced fin surface with 4 bumps, the first of which being positioned at 30° from a tube centerline.
Figure 6:
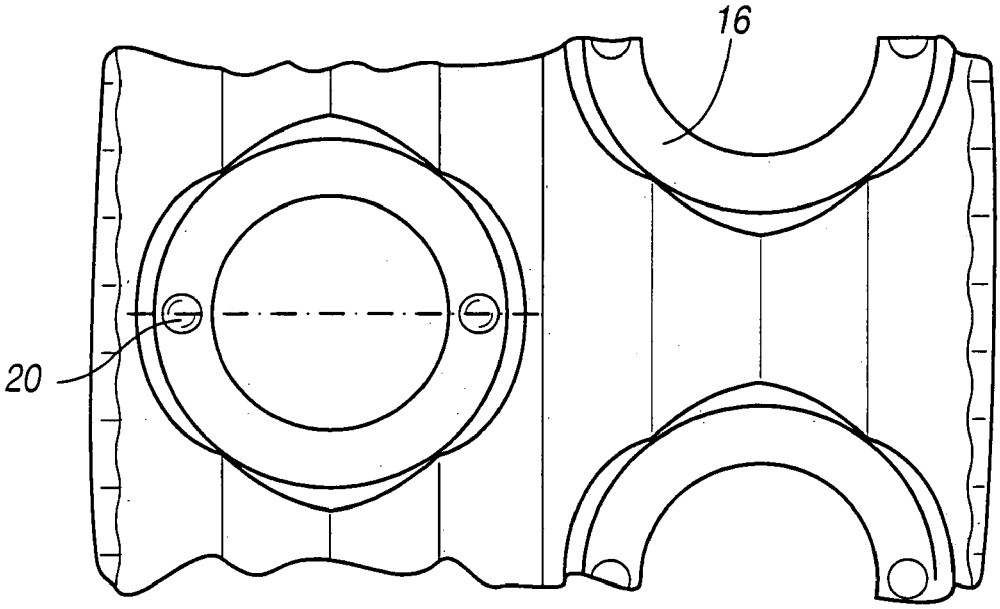
FIG. 6 depicts an alternate embodiment of the inventive heat exchanger wherein there are 2 bumps at the collar—fin surface, that are located on a center line of the tube (180° apart)

FIG. 4 depicts a typical fin collar base 16 which contacts the outside perimeter 18 of a tube. Conventionally, the thin collar base 16 is smooth. One method of improving air side heat transfer through the fin is to disturb laminar (boundary layer) air flow by creating a fin surface geometry that increases the effectivity of the fin surface area in promoting heat transfer.

The present invention contemplates the provision of protrusions or bumps 20 (FIGS. 5–6) that are provided upon the collar bases 16. Such protrusions tend to disturb the passage of the second heat transfer fluid and improving the thermodynamic efficiency of heat transfer.

It will be appreciated that the bumps 20 can be formed by pressing the fin surface up or down in small localized spots. Bumps can also be deposited onto the fin surfaces as desired. The shapes of the bump can be spherical, cone-shaped, pyramidal, or any other shape or protrusion.

In an alternate embodiment, the bumps may be perforated in order to reduce the air side pressure drop across the fin's surface. It will be appreciated that the protrusions 20 could be formed by tears in the fin plane. Such tears may be formed around at least part of the perimeter of a base of a protrusion. Alternatively, the tears could be formed at an upper opening in an extension from the planar surface.

Table 1 (below) reports the Computational Fluid Dynamic modeling (CFD) results obtained with various collar base bump patterns at 2 levels of coil face velocity under dry surface conditions (V = 300 ft/min V = 1400 ft/min):

| Design Options | | | |
|---|---|---|---|
| Number of Protrusions without Perforations[1] | Angle of Leading Bumps From Tube Centerline | Percentage of Improvement in Heat Transfer[2] (%) V = 300 ft/min | V = 1400 ft/min |
| 2 | 0° | 5.5 | 9.1 |
| 4 | 15° | 5.8 | 9.3 |
| 4 | 30° | 5.9 | 9.5 |
| 4 | 60° | 6.8 | 12.5 |
| 8 | 30° | 6.8 | 13.1 |
| 8, with perforation | 30° | 6.4 | 12.4 |

[1]Conventional corrugated fins have no bumps on the collar base.
[2]The percentage increase is relative to the bump-free fin surfaces.

Of interest is the percentage improvement of heat transfer in relation to bump-free fin surfaces. At V=300 ft/min, for example, the improvement of heat transfer increases when the number of bumps rises from 2 to 4 and the angle of the leading bumps from the tube center line (FIGS. 5–6) increases from 0 to 60°. Similar results are reported when V=1400 ft/min, except that there appeared to be an improvement when the number of bumps was doubled from 4 to 8.

In addition to heat transfer calculations, the CFD analysis was used to calculate the associated pressure drop changes due to the addition of protrusions to the fin collars. A comparison was made for eight protrusions with and without perforations, as noted in Table 1. At 300 and 1400 ft/min coil face velocities, approximately 4% reduction in pressure drop was achieved with perforated protrusions.

The provision of a perforation in each of the 8 protrusions (when the angle of the leading protrusions in relation to a tube center line was 30°) appeared to contribute little to the efficiency of heat transfer, and if anything diminished it slightly. Preferably, if a perforation is provided on a bump, the perforation should be smooth and regular—not faceted. In some cases, the perforation may be located near a protrusion's perimeter area and may be irregular.

Preferably, the protrusion's shape is spherical and a protrusion's arch length is 1.3 times that of its sector length.

In general, there are two options for the preferred number and location of protrusions: in one example, there are 4 protrusions (FIG. 5) around a collar or base, with the leading protrusions oriented at 30° from a center line of the collar base. In another embodiment (FIG. 6), there are 2 protrusions provided around the collar base. Each of the 2 protrusions is located on a tube center line (i.e., 180° apart).

Figure 3:
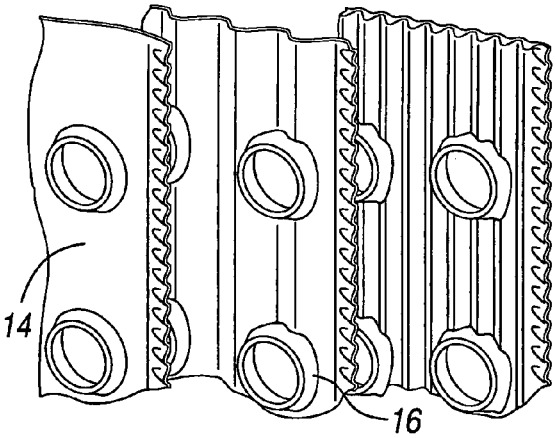
FIG. 3 (PRIOR ART)
FIG. 3 shows commercially available examples of conventional air side fins.

It should be realized that the air side fins that are considered to be within the scope of this invention may be planar or may contain louvers, corrugations, or wavy surface features (see, e.g., FIG. 3).

EXAMPLES

The data of Table 1 were analyzed using Computational Fluid Dynamics (CFD) software [Fluent (ver. 6.1)] to simulate the air side performance —including heat transfer and pressure drop on a bump-enhanced corrugated fin at different air side face velocities.

The simulation conditions were:

The CFD simulation modeled hot water wind tunnel test on a 2-row, ⅜", 1×0.75 coil.

Airside inlet dry bulb temperature: 80° F.

Airside inlet face velocity: 300 ft/min to 1400 ft/min

Tube side: water inlet temperature=180° F., water outlet temperature=170° to 176° F.

Tube side water inlet velocity: 228 ft/min

As a result of the simulation, when compared with conventional corrugated fin surfaces without enhancement, the inventive protrusion generates an improvement in heat transfer and increases in pressure drop that were reported in Table 1.

Heat exchangers constructed with fins with and without 4 protrusions at 30 degrees (FIG. 5) were tested under wind tunnel test conditions listed below in Tables A–D.

TABLE A

Test Conditions For the Second Heat Transfer Fluid (Dry Surface)

| Barometric Pressure | Inlet Dry (F.) | Inlet Wet (F.) | Outlet Dry (F.) | Outlet Wet (F.) | Pressure Drop H2O | Coil Face Velocity ft/min |
|---|---|---|---|---|---|---|
| 30.34 | 80.03 | 61.02 | 149.73 | 81.52 | 0.0842 | 250 |
| 30.34 | 79.95 | 61.34 | 146.46 | 81.03 | 0.1014 | 300 |
| 30.34 | 79.88 | 61.62 | 140.03 | 79.72 | 0.1549 | 401 |
| 30.33 | 79.88 | 61.80 | 134.98 | 78.59 | 0.2179 | 500 |
| 30.34 | 80.01 | 58.32 | 131.57 | 75.25 | 0.2759 | 600 |
| 30.35 | 79.95 | 58.32 | 126.64 | 73.92 | 0.3961 | 751 |
| 30.36 | 80.08 | 58.32 | 120.51 | 71.94 | 0.6278 | 1000 |
| 30.37 | 80.10 | 58.31 | 116.81 | 70.82 | 0.8463 | 1200 |

TABLE B

Test Conditions For the First Heat Transfer Fluid (Dry Surface)

| Total pressure drop Ft. H2O | Temp. In Deg. F. | Temp. Out Deg. F. | Fluid Density Lbs/Cu.Ft | Flow Rate Lbs/Min |
|---|---|---|---|---|
| 23.87 | 180.07 | 176.77 | 60.65 | 170.80 |
| 23.95 | 180.03 | 176.33 | 60.63 | 170.48 |
| 23.86 | 180.05 | 175.61 | 60.61 | 170.49 |
| 23.81 | 180.04 | 174.91 | 60.61 | 170.23 |
| 23.80 | 180.08 | 174.43 | 60.63 | 170.28 |
| 23.87 | 180.04 | 172.67 | 60.65 | 170.29 |
| 23.83 | 180.07 | 172.08 | 60.63 | 170.42 |

TABLE C

Test Conditions For the Second Heat Transfer Fluid (Wet Surface)

| Barometric Pressure | Inlet Dry (F.) | Inlet Wet (F.) | Outlet Dry (F.) | Outlet Wet (F.) | Pressure Drop "H2O | Coil Face Velocity FPM |
|---|---|---|---|---|---|---|
| 30.20 | 80.10 | 66.97 | 64.14 | 60.60 | 0.3840 | 601 |
| 30.21 | 80.08 | 67.09 | 63.47 | 60.25 | 0.3612 | 550 |
| 30.23 | 80.09 | 66.88 | 62.76 | 59.68 | 0.3350 | 500 |
| 30.26 | 80.00 | 66.91 | 61.92 | 59.19 | 0.3173 | 450 |
| 30.27 | 79.93 | 67.05 | 61.15 | 58.72 | 0.2871 | 401 |
| 30.39 | 80.11 | 67.10 | 60.15 | 57.98 | 0.2563 | 350 |
| 30.41 | 79.91 | 67.10 | 59.04 | 57.12 | 0.2111 | 300 |
| 30.42 | 80.04 | 67.09 | 57.72 | 56.07 | 0.1674 | 250 |

TABLE D

Test Conditions For the First Heat Transfer Fluid (Wet Surface)

| Total Pressure Drop Ft. H2O | Temp. In Deg. F. | Temp. Out Deg. F. | Fluid Density Lbs/Cu.Ft | Flow Rate Lbs/Min |
|---|---|---|---|---|
| 25.02 | 45.07 | 47.14 | 62.25 | 175.88 |
| 25.03 | 45.04 | 47.08 | 62.26 | 175.44 |
| 24.85 | 45.02 | 46.94 | 62.28 | 175.92 |
| 24.96 | 44.98 | 46.84 | 62.26 | 175.64 |
| 24.92 | 45.07 | 46.84 | 62.32 | 175.47 |
| 24.96 | 45.17 | 46.81 | 62.23 | 175.91 |
| 25.21 | 45.21 | 46.75 | 62.28 | 176.01 |
| 25.16 | 45.06 | 46.47 | 62.28 | 175.90 |

The experimental data reported below and in FIGS. 7–8 support the CFD modeling data presented earlier in Table 1.

In Table E, when the coil surface is dry (condenser applications) there is improvement on the airside convection coefficient of about 7% over the range of tested coil face velocities. There is no significant increase in pressure drop, which provides further benefit in coil performance.

TABLE E

Comparison Of Heat Transfer and Pressure Drop For Coils Under Dry Surface Condition

| | Coil Face Velocity (FPM) | Airside Convection Coefficient (Btu/hr-ft^2-F) | Airside Pressure Drop (in H2O) |
|---|---|---|---|
| Coil With 4 Bumps at 30° | 250.39 | 8.44 | 0.0399 |
| | 300.09 | 9.35 | 0.0509 |
| | 400.49 | 10.83 | 0.0745 |
| | 500.05 | 12.09 | 0.1053 |
| | 600.56 | 13.63 | 0.1351 |
| | 749.86 | 15.42 | 0.1934 |
| | 1000.06 | 17.84 | 0.3066 |
| | 1199.25 | 19.42 | 0.4157 |
| | 250.08 | 8.98 | 0.0421 |
| | 299.79 | 9.99 | 0.0507 |
| | 400.54 | 11.64 | 0.0775 |
| | 499.89 | 13.13 | 0.1090 |
| | 599.73 | 14.58 | 0.1379 |
| | 750.53 | 16.43 | 0.1980 |
| | 999.65 | 19.12 | 0.3139 |
| | 1200.15 | 20.93 | 0.4232 |

Figure 7:
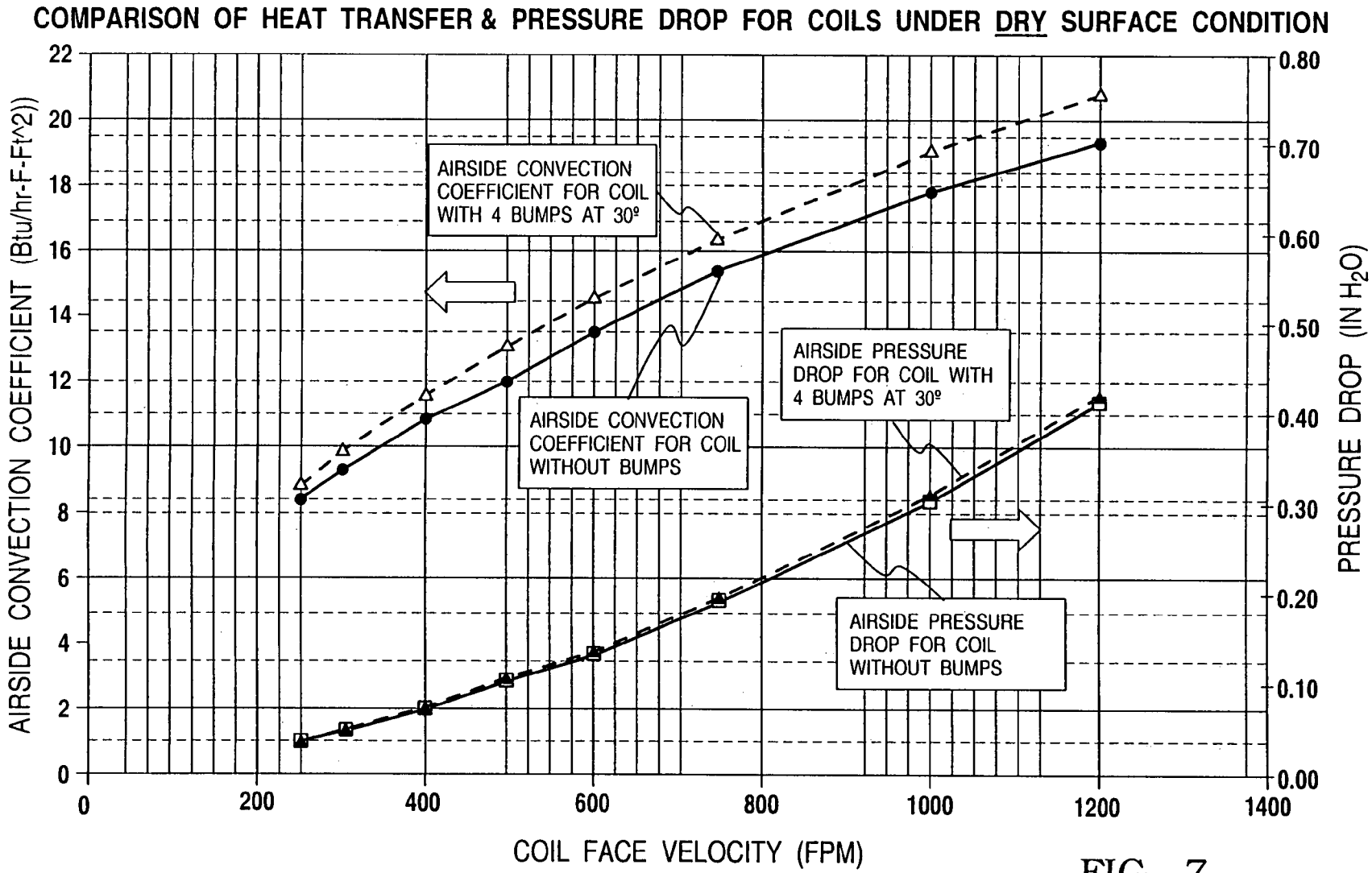
FIG. 7 is a comparison of test results between fins with and without protrusions (dry surface)

The data are presently in graph form in FIG. 7.

TABLE F

Comparison Of Heat Transfer And Pressure Drop For Coils Under Wet Surface Condition

| | Coil Face Velocity (FPM) | Airside Convection Coefficient (Btu/hr-ft^2-F) | Airside Pressure Drop (in H2O) |
|---|---|---|---|
| Coil w/o Protrusions | 250.41 | 13.84 | 0.0768 |
| | 300.00 | 15.17 | 0.0963 |
| | 350.35 | 16.22 | 0.1224 |
| | 399.85 | 17.25 | 0.1461 |
| | 449.63 | 17.97 | 0.1618 |
| | 499.71 | 18.14 | 0.1706 |
| | 500.18 | 18.98 | 0.1835 |
| | 599.80 | 19.49 | 0.1952 |
| | 250.09 | 14.11 | 0.0837 |
| Coil With 4 Protrusions at 30° | 300.04 | 15.60 | 0.1056 |
| | 349.80 | 16.38 | 0.1281 |
| | 400.59 | 17.52 | 0.1436 |
| | 449.54 | 18.19 | 0.1586 |
| | 499.80 | 18.78 | 0.1675 |
| | 550.31 | 20.22 | 0.1806 |
| | 600.67 | 20.37 | 0.1920 |

Figure 8:
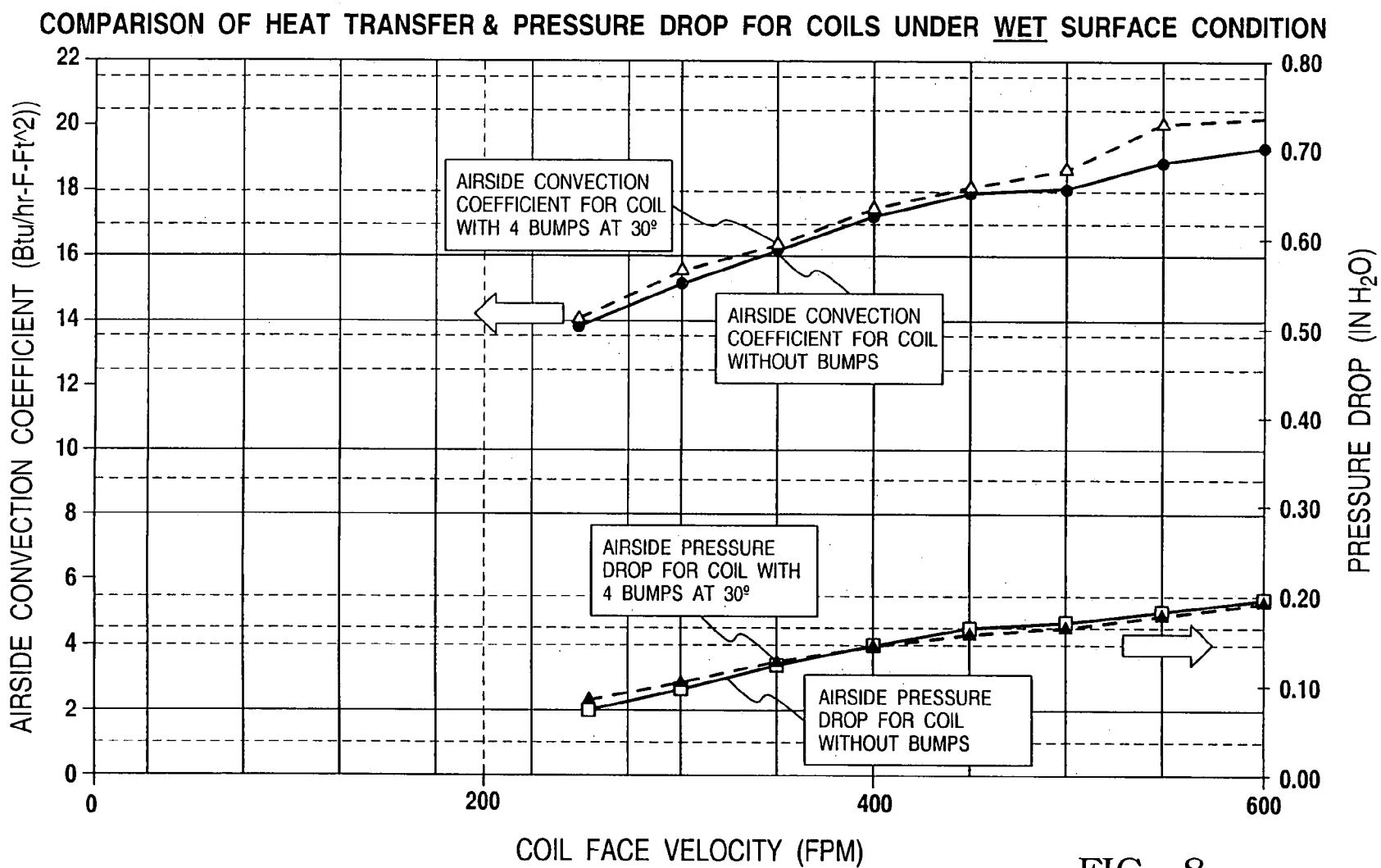
FIG. 8 is a comparison of test results between fins with and without protrusions (wet surface).

The data are presented in graph form in FIG. 8.

In Table F, when the coil surface is wet (evaporator applications), the airside convection coefficient for a fin with protrusions is about 3% higher than that for the fin without protrusions. The pressure drop for the fin with protrusions is 1% higher than that for a fin without protrusions. The difference disappears when the face velocity is above 400 ft/min.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A heat exchanger for heating, ventilation, air conditioning and refrigeration applications, the heat exchanger having one or more tubes for carrying a first heat transfer fluid;

one or more fins, each having a first surface and a second surface in thermal communication with the tubes, at least some of the fins having a plurality of annular fin collar bases that are located around the outside perimeters of the tubes, the bases extending from the first surface, at least some of the plurality of fin collar bases being provided with a plurality of bumps that extend at least partially convexly from the first surface for disturbing the heat transfer fluid.

2. The heat exchanger of claim 1 wherein the first heat transfer fluid comprises a refrigerant.

3. The heat exchanger of claim 1 wherein the second heat transfer fluid comprises air.

4. The heat exchanger of claim 1 wherein the plurality of bumps comprises four bumps.

5. The heat exchanger of claim 1 wherein at least some of the plurality of bumps have a shape that is selected from the group consisting of spherical, cone-shaped, pyramidal, and combinations thereof.

6. The heat exchanger of claim 5 wherein at least some of the bumps define one or more perforations in order to reduce the airside pressure drop across a fin's surface.

7. The heat exchanger of claim 1 wherein the one or more fins have a surface topography that is selected from the group consisting of a plane, a louver, a corrugation, a wave, and combinations thereof.

8. The heat exchanger of claim 1, wherein at least some of the bumps are characterized by spherical arc length and a sector length, the arc length being about 1.3 times the sector length.

9. The heat exchanger of claim 1, wherein at least some of the bumps have a shape that is selected from the group consisting of an ellipsoid and a faceted sphere.

10. The heat exchanger of claim 1, wherein a plurality of bumps comprises four bumps, at least one being-oriented at 30 degrees from an incoming airflow direction through a tube center line.

11. The heat exchanger of claim 1, wherein the plurality of bumps comprise two bumps that are spaced 180 degrees apart in relation to a tube center line.

12. The heat exchanger of claim 1, wherein the first heat transfer fluid comprises a combustion gas.

13. The heat exchanger of claim 1, wherein the second heat transfer fluid comprises water.

14. The heat exchanger of claim 13, wherein the water is supplemented with an antifreeze.

15. A method for improving the efficiency of a fin-tube heat exchanger, comprising the steps of:

providing tubes for carrying a first heat transfer fluid;

fabricating one or more fins to accommodate the tubes;

forming a collar with an annular fin collar base in the one or more fins so that a predefined pattern of protrusions is formed in the fin collar base and extends at least partially convexly from one side of the fins placing one or more of the fins in thermal communication with the tubes;

positioning the fin collar bases around the outside perimeters of at least some of the tubes, so that at least some of the protrusions disturb a second heat transfer fluid that passes over the fins and the tubes.

16. A heat exchanger for heating, ventilation, air conditioning and refrigeration applications, the heat exchanger having one or more tubes for carrying a first heat transfer fluid;

one or more fins, each having a first surface and a second surface in thermal communication with the tubes, at least some of the fins having a plurality of annular fin collar bases that are located around the outside perimeters of the tubes, the bases extending from the first surface, at least some of the plurality of fin collar bases being provided with a plurality of bumps that extend at least partially convexly from the second surface for disturbing the heat transfer fluid.

* * * * *